343-700 MS AU 254 EX
12/27/83 XR 4,423,392

United States Patent [19]
Wolfson

[11] 4,423,392
[45] Dec. 27, 1983

[54] DUAL-MODE STRIPLINE ANTENNA FEED PERFORMING MULTIPLE ANGULARLY SEPARATED BEAMS IN SPACE

[76] Inventor: Ronald I. Wolfson, 10966 Beckford Ave., Northridge, Calif. 91326

[21] Appl. No.: 325,686

[22] Filed: Nov. 30, 1981

[51] Int. Cl.[3] ..... H01P 5/18; H01Q 3/26
[52] U.S. Cl. ..... 333/116; 343/700 MS
[58] Field of Search ..... 333/115, 116; 343/700 MS

[56] References Cited

U.S. PATENT DOCUMENTS 2,531,438 11/1950 Jones ..... 333/115 X
2,775,740 12/1956 Oliver ..... 333/115

*Primary Examiner*—Paul L. Gensler

[57] ABSTRACT

A non-dispersive antenna feed in which a length of strip transmission line (stripline) has two spaced center conductors supported on a dielectric sheet between two ground planes. These center conductors or conductive strips produce an even-mode electric field between the two ground planes when excited in-phase and an odd-mode electric field when the center conductors are excited in anti-phase relationship. A plurality of close-coupled quarter wave conductors parallel one of the center conductors, a feed strip extends substantially orthogonally from each such coupling strip to provide an antenna element feed externally. A four poor hybrid has two external ports and two additional ports for discretely feeding the stripline center conductors in-phase corresponding to excitation of one hybrid external port an in anti-phase corresponding to excitation of the other hybrid port. Each external hybrid port thereby corresponds to a different angle of antenna beam generation.

7 Claims, 5 Drawing Figures

DUAL-MODE STRIPLINE ANTENNA FEED PERFORMING MULTIPLE ANGULARLY SEPARATED BEAMS IN SPACE

BACKGROUND OF THE INVENTION

1. Field of the Invention

The invention relates to directive antennas in general and, more particularly, to radar system antenna feed arrangements for generating at least two angularly separated beams in space from a linear array of antenna elements.

2. Description of the Prior Art

In the prior art, various scanning and/or tracking radar equipments require the generation of at least one pair of angularly separated beams which can be electronically (inertialessly) switched without modification of the excitation frequency of the antenna system.

Other well known prior art radar systems employ the so-called mono-pulse technique in which a pair of angularly close-spaced beams are required, associated circuitry being operative to produce the so-called sum and difference patterns employed in mono-pulse.

The concept of a dual-mode slotted-waveguide array where the propagation coefficients of the two modes can be independently adjusted to produce separate angularly separated beams in space is known. Such a system is described in U.S. Pat. No. 4,164,742 assigned to the assignee of the present application. In that reference, the mechanism employed to achieve the difference phase velocities for the two modes relies upon selection of the amount of energy coupled through a common wall between parallel waveguides. Accordingly, two simultaneous beams can be independently located, usually with relatively small angular separation, at a single excitation frequency and in the plane parallel to the array length. The array itself in that situation is preferably comprised of slots in a narrow wall of one of the two coupled parallel waveguides.

The concept disclosed in that reference U.S. patent is further discussed and applied to the mono-pulse situation in a paper entitled "Dual-Beam Waveguide Slot Array for Monopulse Application". That paper by G. A. Hockham and R. I. Wolfson, appeared in the International IEEE AP-S Symposium Digest, pages 688–691, June 1979.

Basically, any device employing a waveguide encounters the so-called "cut-off" frequency problem and is inherently dispersive. That is, looking at the waveguide itself as a piece of transmission line, it will be realized that the phase delays encountered along the transmission line are functions of frequency, this because waveguide TE modes are dispersive and subject to cut-off. The result of this phenomenon is that, in the prior art dual-beam waveguide device, the angular separation between the two beams does not remain constant for every operating frequency encountered.

Since the invention concerns non-dispersive, dual-mode transmission line elements, it may theoretically be implemented in coaxial line, stripline, microstrip, slab line or the like, however, the implementation in stripline hereinafter particularly described is considered the preferred embodiment. For further background in connection with suitable instrumentation of strip transmission line (stripline) for purposes of constructing the present invention, the prior art of knowledge to the practitioner in this art is relied upon. Two additional technical papers are particularly pertinent in respect to the technical background necessary for an understanding of and for practice of the invention. These are the paper entitled "Shielded Coupled-Strip Transmission Line", by S. B. Cohn, IEEE Transactions, Vol. MTT-3, pages 29–38, October 1955; and the paper "Problems in Strip Transmission Lines", also by S. B. Cohn, appearing in IEEE Transactions, Vol. MTT-3, pages 119–126, March 1955.

The details of the stripline implementation according to the invention are presented hereinafter.

SUMMARY OF THE INVENTION

It may be said to have been the general objective of the present invention to produce an efficient low cost, non-dispersive, dual-mode stripline antenna feed for the formation of a desired multiple angularly spaced beams whose angular spacing remains constant over a wide band of frequencies.

For the typical implementation of the invention, stripline transmission medium has been selected for description. A pair of relatively close-spaced conductive strips placed on a dielectric substrate or sheet is placed in typical stripline fashion between two parallel ground plates or planes. The performance in respect to even-mode electric fields pertains when the two conductive strips (center conductors) are excited in-phase. The electric field vectors are substantially symmetrical in that the same uniform pattern exists between each of the conductive strips and the ground planes. In the odd-mode electric field distribution situation, corresponding to anti-phase excitation of the conductive strips, a slowing of the phase velocity of energy propagating longitudinally down the stripline occurs, largely because of the effect of the dielectric substrate in the region between the facing edges of the conductive strips. The remainder of the volume between the ground planes is either air or a material having a dielectric constant close to that of air or at least much less than that of the dielectric substrate supporting the conductive strips. Thus, excitation of the conductive strips mutually in-phase produces the so-called even-mode electric field and a phase velocity of substantially C, thereby producing a beam from the elements of a linear array coupled progressively along one of the conductive strips, which is at a first angle in space. Anti-phase excitation of the conductive strips produces an odd-mode electric field pattern and consequently generates a beam at a second angularly separated position in space. Simultaneous excitation of the two strips by means of a phasing device such as a four port hybrid will produce both of those beams simultaneously and in relative amplitudes corresponding to the applied conductive strip input amplitudes.

A detailed description of the stripline implementation follows.

DETAILED DESCRIPTION

Figure 1:
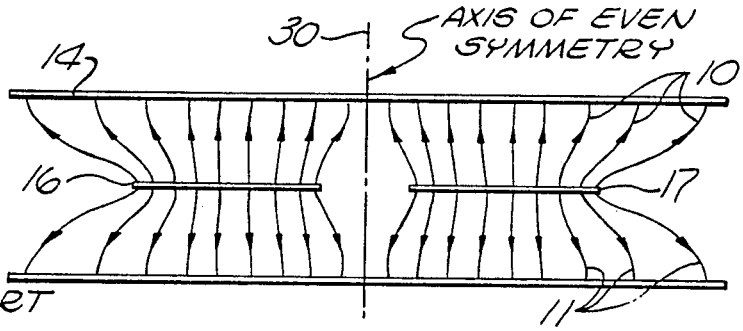
FIG. 1 PRIOR ART
FIG. 1 is a prior art end view of a two conductor strip transmission line (stripline) showing even-mode electric field distribution.

Referring now to FIG. 1, the nature of the electric field distribution in the even-mode situation is shown to be essentially symmetrical about a plane perpendicular to the conductive strips and ground planes, centered between the two conductive strips and extending longitudinally along the stripline. Typical field vectors at 10 have a polarity opposite to those indicated at 11, this being entirely conventional.

Figure 2:
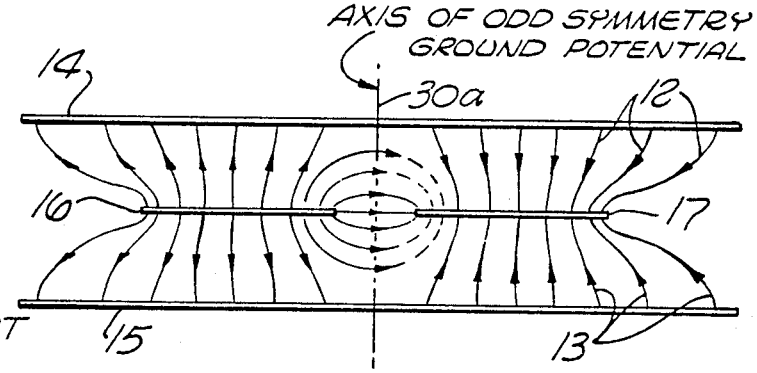
FIG. 2 PRIOR ART
FIG. 2 is the same view of the same stripline configuration as shown in FIG. 1 except that odd-mode electric field distribution is depicted.

In FIG. 2, representing the situation in which the conductive strips 16 and 17 are excited in anti-phase, it will be noted that the principle field vectors between the strip 16 and the ground planes remain as in FIG. 1 whereas those associated with the conductive strip 17 have polarities reversed at 12 and 13 vis-a-vis those shown at 10 and 11 in FIG. 1. In addition, a fringing field condition between the facing edges of the conductive strips 16 and 17 is seen.

Figure 3:
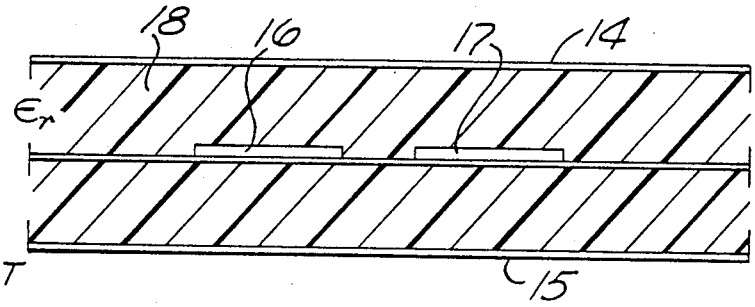
FIG. 3 PRIOR ART
FIG. 3 is a conventional prior art solid-dielectric two conductor strip transmission line.

A frequent conventional form of the solid-dielectric stripline having two conductive strips as center conductors 16 and 17 is shown in FIG. 3, with ground planes 14 and 15 and solid dielectric 18 having a dielectric constant $\epsilon_r$.

Figure 4:
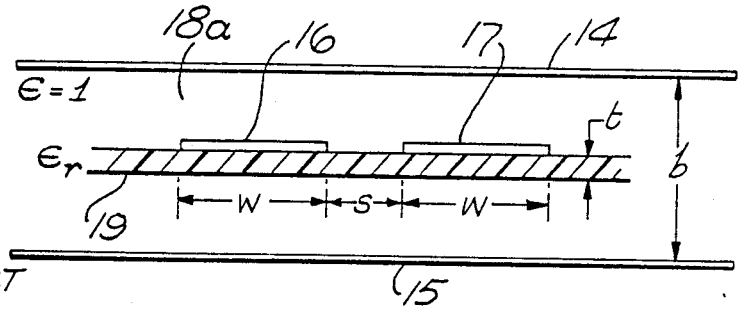
FIG. 4 PRIOR ART
FIG. 4 depicts the end view of an air-dielectric stripline with conductor strips supporting substrate as employed in the invention.

Passing on to FIG. 4, the practical form of the air-dielectric stripline according to the invention has a volume 18*a* of air, or of a material having a dielectric constant close to that of air. A dielectric substrate 19, however, provides a dielectric constant of $\epsilon_r$ substantially higher than $\epsilon=1$ for the air-dielectric represented at 18*a*. The physical dimensions b, t, w and s will be referred to as this description proceeds.

Figure 5:
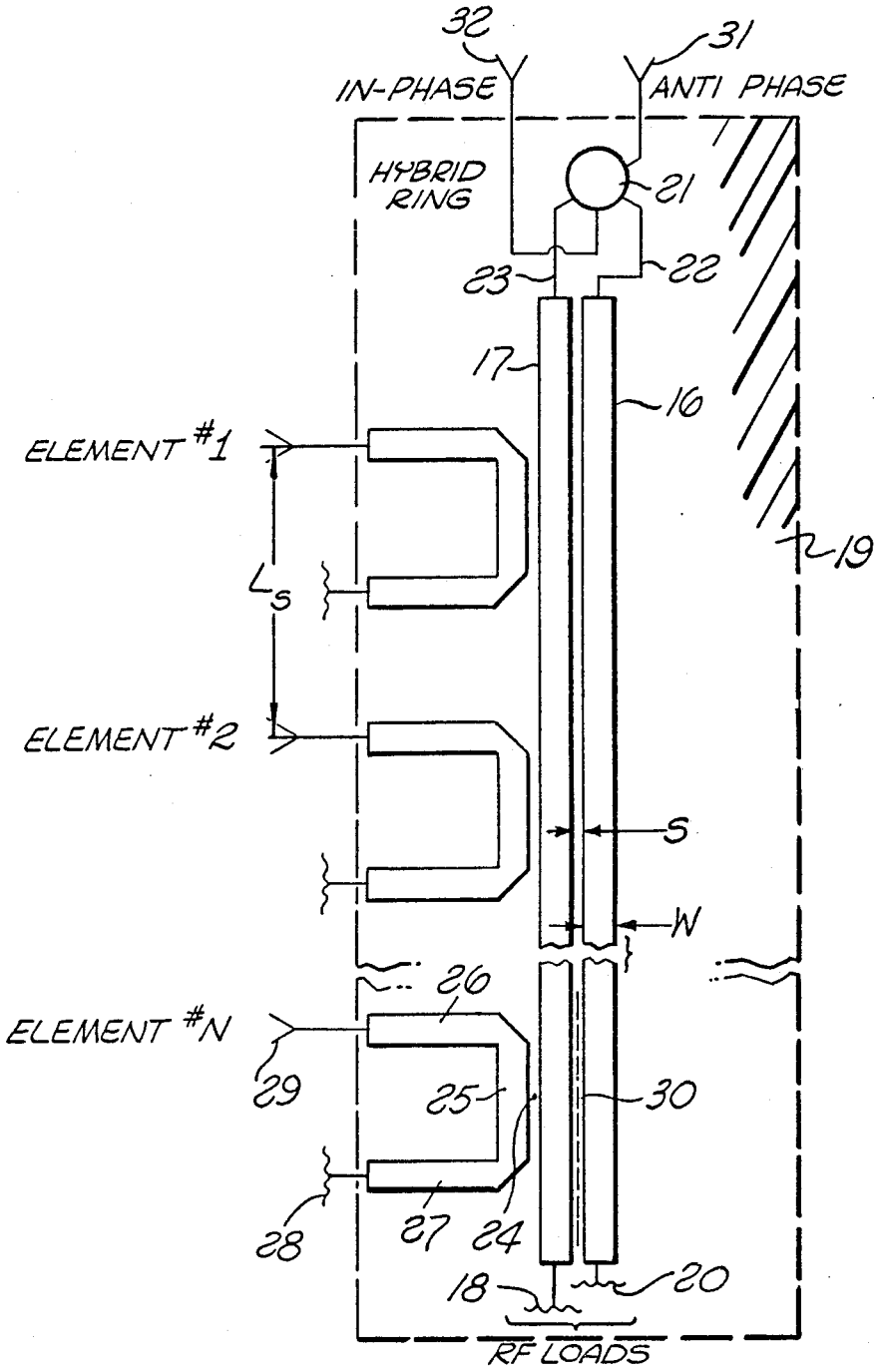
FIG. 5 is a schematic block diagram and plan view of the stripline of FIG. 4 with cooperating elements including a four port hybrid ring and a plurality of antenna element port coupling devices, and with the ground planes of FIG. 4 removed for clarity.

Referring now to FIG. 5, a typical configuration for the implementation of the inventive concept in stripline is shown the ground planes 14 and 15 having been omitted for clarity.

FIGS. 1 and 2 show the transverse electric field distributions for two fundamental TEM modes that can exist on a pair of parallel conducting strips 16 and 17 between parallel ground planes 14 and 15. In the FIG. 1, the strips 16 and 17 are at the same potential (in-phase) and carry equal currents in the same direction. Because of even symmetry of the field about the vertical axis 30, this mode is called the even-mode.

In FIG. 2, the strips are at equal but opposite potentials and carry equal currents in opposite directions. Due to the odd field symmetry, this mode is called the odd-mode. For the odd-mode, the vertical plane of symmetry 30*a* is at ground potential; hence, it may be replaced by a thin conducting wall joined electrically to the horizontal ground planes 14 and 15. It is evident from the field plots that the capacitance to ground per strip is less for the even-mode and greater for the odd-mode than for a single isolated strip of the same width. Therefore, the characteristic impedances of the two modes are unequal, being greater for the even-mode. This fact is, however, not of primary importance in the realization of an embodiment of the invention and its operation.

Considering the two stripline transverse cross-sections shown in FIGS. 3 and 4, it will be noted that FIG. 3 shows thin conducting strips 16 and 17 in a solid fill of dielectric having relative dielectric constant $\epsilon_r$. For this case, the phase velocity is the same for both modes, and is given by $$v=c/\sqrt{\epsilon_r}$$

where c is the velocity of light in free space.

The construction shown in FIG. 4 consists of the same thin conducting strips printed on a thin dielectric sheet 19 that is supported, either in air or in a low-dielectric material, midway between the same ground planes. Because the electric field energy in the dielectric sheet is greater for the odd-mode than for the even-mode, the phase velocity for the former will be less than for the latter. The phase velocity of the even-mode cannot be computed accurately, but it will usually be only on the order of one percent less than the velocity of light in free space. On the other hand, the phase velocity of the odd-mode will be much more noticeably affected by the field in the dielectric 19 in the gap section between strips 16 and 17 in the manner illustrated in FIG. 2. The following formula is given in the S. B. Cohn paper (MTT-3, pp. 29–38, October 1955) hereinabove identified, for the ratio of the phase velocities of the two modes:

$$\frac{v_{oo}}{v_{oe}} = \frac{1 + [2Z_{oo}(w/b,o,s/b)Z_o(w/b,o)/(377)^2]}{1 + [2\epsilon_r Z_{oo}(w/b,o,s/b)Z_o(w/b,o)/377)^2]}$$

where $Z_{oo}$ (w/b, o, s/b) is the odd-mode impedance for a pair of (theoretical) zero-thickness conducting strips of width w, separation s, and ground phane spacing b. These parameters influence $Z_{oe}$ and $Z_{oo}$ in a manner well examined by Cohn. $Z_o$(w/b,o) is the characteristic impedance of a single strip of width w, thickness zero and ground plane spacing b. Values of $Z_o$ can also be determined from the work of Cohn. The term $\epsilon_r$ is the relative dielectric constant of the thin dielectric sheet 19.

The beam angle in space, $\theta$, is given by $$\sin\theta = \frac{c}{v_o} - \frac{\lambda o}{2L_s} \approx \sqrt{\epsilon_r} - \frac{\lambda o}{2L_s}$$

where λo is wavelength in air, $L_s$ is the element spacing for beam normal, that is, $\theta=0$, and $\sqrt{\epsilon_r}$ is approximately equal to one for the even-mode, and significantly greater than one for the odd-mode.

In the final analysis, the inventive concept comes forth from the realization according to FIG. 5. Here a plan view of strips 16 and 17 is illustrated. The conductive planes 14 and 15 are not shown here but, of course, they would be included in the operative assembly. It should also be noted that scale and proportion are not necessarily as depicted in FIG. 5, some typical dimensions being given hereinafter.

In FIG. 5, the strips 16 and 17 are driven from a four port hybrid ring 21, so that excitation of hybrid port 32 provides in-phase signals at 22 and 23, whereas excitation of 31 provides excitation in an anti-phase relationship (i.e., 180° phase difference) between 22 and 23. The corresponding mode patterns produce the two angularly separated beams alternatively switchable or simultaneously if both 31 and 32 are excited contemporaneously. The relative beam amplitudes are proportional to the respective excitation amplitudes at 31 and 32.

Conventional terminal loads 18 and 20 are provided as indicated, and the plural antenna element ports are each excited from a quarter-wave pick-up or coupling conductor. Typically, element port N connects to one end of quarter-wave coupling strip 25 via lead 26 of arbitrary length (non-resonant). A similar lead 27 is connected to an individual termination load 28.

The coupling gaps, typically 24 in a practical L band (1.2 to 1.8 GHz) version, were set at 0.01 inches and the conductive strip spacing (determining even/odd-mode line impedance ratio) was set at 0.1 inches. Conductive strips 16, 17, 25, 26 and 27 were on the order of 0.35 inches wide in that implementation (designed for approximately 50 ohms impedance).

It will be evident that printed circuit techniques are applicable to the structure of FIG. 5, including the hybrid ring 21, although the latter could also be otherwise conventionally instrumented independently of the stripline structure.

The antenna elements connected at element ports 1 through N generally form a linear array, although the elements themselves could each comprise a column of elements forming an overall planar array.

During frequency scan (variation of the signal frequency at ports 31 and 32 together), a particular advantage of the invention is afforded, namely, that the angular offset between the two beams remains constant.

The feed system of the invention is obviously reciprocal and, although terms such as "excitation" are used at various points for explanation, the operation in a receiving mode will be evident to the skilled practitioner.

Various modifications of the implementation and extensions of the inventive concept will suggest themselves to those of skill in the art. Accordingly, it is not intended that the drawings or this description should be considered to limit the scope of the invention, the drawings and specification being intended to be typical and illustrative only.

One or more additional beams could be conceivably generated if an additional strip parallel to 16 and 17 were added along with appropriate gap dielectric material and appropriate feed arrangements, resulting in three or more angularly discrete beam positions.

The manner of employment of the device of FIG. 5 in a monopulse system will be evident to the skilled person in this art, the adaptations ahead of ports 31 and 32 being conventional for the purpose.

What is claimed is:

1. An antenna feed having first and second transmit/-receive ports and a plurality of antenna element ports for connection to the elements of a linear antenna array to generate at least two angularly separated beams in space therefrom, comprising:

a length of non-dispersive TEM transmission line having first and second generally parallel, laterally-spaced center conductors associated with a dielectric material and discretely connected to said first and second transmit/receive ports, respectively, the other ends of said center conductors being discretely load terminated;

first means comprising a phasing device having in-phase and anti-phase ports and third and fourth ports connected to said transmission line first and second transmit/receive ports, respectively, said phasing device being operative to excite said center conductors in-phase to generate an even electric field mode within said transmission line during excitation of said in-phase port and to excite said center conductors in anti-phase relationship to generate an odd electric field mode within said transmission line during excitation of said anti-phase port;

second means comprising a plurality of couplings, one for each of said antenna element ports, said couplings each including a quarter-wave conductor parallel and close coupled to one of said center conductors and a feed strip extending generally perpendicular from one end of each of said coupling strips to a corresponding antenna element port, said coupling strips being load terminated from their other ends.

2. An antenna feed according to claim 1 in which said transmission line is a length of stripline including first and second substantially parallel, elongated, conductive plates and in which said center conductors are a pair of laterally spaced conductive strips insulatingly supported in a plane parallel to, and substantially mid-way between, said conductive plates.

3. An antenna feed according to claim 2 in which said insulating support for said conductive strips comprises a flat dielectric sheet substantially parallel to said conductive plates, having a thickness which is a relatively small fraction of the spacing between said conductive plates and having a dielectric constant greater than that of air.

4. An antenna feed according to claim 1, 2 or 3 in which said first means comprises a four port hybrid.

5. An antenna feed according to claim 3 in which said conductive strips, said couplings and said hybrid are printed circuit elements affixed to said dielectric sheet.

6. The device according to claim 2 in which said insulating support provides said associated dielectric material, said dielectric material having a dielectric constant large compared to that of air and the remaining volume between said conductive plates having a substantially lower dielectric constant than that of said insulating support.

7. The device according to claim 6 in which said remaining volume is air.

* * * * *